United States Patent [19]

Early et al.

[11] 4,202,301

[45] May 13, 1980

[54] OXYGEN SENSOR CONTROL SYSTEM

[75] Inventors: Jack Early, Perth Amboy; John J. Mooney, Wyckoff; Carl D. Keith, Summit, all of N.J.

[73] Assignee: Engelhard Minerals & Chemicals Corporation, Iselin, N.J.

[21] Appl. No.: 829,555

[22] Filed: Aug. 31, 1977

[51] Int. Cl.[2] ..... F02D 3/00

[52] U.S. Cl. ..... 123/119 EC; 123/32 EE; 123/32 EA

[58] Field of Search ..... 123/32 EE, 32 EB, 117 D, 123/32 EA, 119 EC, 32 EA, 32 EC; 60/276, 285

[56] References Cited

U.S. PATENT DOCUMENTS

| | | | |
|---|---|---|---|
| 3,948,228 | 4/1976 | Luchaco | 123/32 EE |
| 3,964,258 | 6/1976 | Romano et al. | 60/285 |
| 3,986,352 | 10/1976 | Casery | 60/276 |
| 4,019,474 | 4/1977 | Nishimiya et al. | 60/276 |
| 4,073,269 | 2/1978 | Herth et al. | 60/285 |
| 4,073,270 | 2/1978 | Endo | 123/32 EC |

*Primary Examiner*—Charles J. Myhre
*Assistant Examiner*—R. A. Nelli

[57] ABSTRACT

An air-to-fuel ratio control mechanism in an internal combustion engine operates in partial response to the output of a control circuit, which circuit in turn is responsive to the output of an oxygen sensor mounted in the exhaust of the engine. The control circuit biases the control mechanism toward a predetermined desired air-to-fuel ratio, normally at or near stoichiometric. When the sensor output deviates above a first predetermined value or below a second predetermined value for longer than a predetermined time period, a comparator circuit provides a disabling signal which disconnects the control circuit from the air-to-fuel ratio control mechanism. At the same time, the disabling signal connects a predetermined signal to the air-to-fuel ratio control mechanism. This predetermined signal simulates a nominal control circuit output to maintain the air-to-fuel ratio close to stoichiometric or some other preferred setting such as a air/fuel ratio which is lean. An indicator is turned on by the disabling signal to alert the operator to possible malfunction.

8 Claims, 2 Drawing Figures

OXYGEN SENSOR CONTROL SYSTEM

BACKGROUND OF THE INVENTION

This invention relates to the use of an oxygen sensor in a control system for controlling the air-to-fuel ratio in an internal combustion engine. More particularly, this invention relates to the use of the oxygen sensor where a three way conversion catalyst is employed in the exhaust system.

It is known to use catalysts in the exhaust system of an internal combustion engine to oxidize unburned hydrocarbons and carbon monoxide into water and carbon dioxide and to reduce various nitrogen oxides into nitrogen and oxygen.

In order to minimize nitrogen oxide pollution as well as hydrocarbon and carbon monoxide pollution, a so-called three way conversion catalyst can be employed. It is particularly important that the combustion system operate within a narrow range of air-to-fuel ratios around the stoichiometric value when a three way conversion catalyst is employed. A stoichiometric ratio is an air-to-fuel ratio with just enough oxygen so that if combustion is complete all of the fuel will be completely burned to water and carbon dioxide and there will be no oxygen remaining. The operating parameters of the three way conversion catalyst are such that the percentage of hydrocarbons and carbon monoxide converted is substantially less as the air-to-fuel ratio becomes richer than stoichiometric and the percentage of nitrogen oxide converted to nitrogen and oxygen is substantially less as the air-to-fuel ratio becomes leaner than stoichiometric. In some circumstances the optimum compromise between the oxidation function and the reduction function is slightly off of stoichiometric but it is always very close to if not at stoichiometric.

It is known to obtain control of the air-to-fuel ratio by use of a control system in which an oxygen sensor in the path of the exhaust gases provides a signal indicating the level of oxygen in the exhaust. The signal is then used to bring the air-to-fuel ratio to a predetermined ratio, normally stoichiometric or close to stoichiometric. Even with a stoichiometric ratio, there will inevitably be incomplete burning so that there will be pollutants in the exhaust which must be removed by the three-way catalyst. Furthermore, in the operation of a vehicle where load and speed changes are continuous, there will inevitably be short duration variations of the air-to-fuel ratio above and below stoichiometric. As a practical matter it is not possible to control to a stoichiometric ratio at all instances of time. Thus only an average stoichiometric ratio can be achieved.

If the oxygen sensor or associated circuitry fails either because of a short or an open circuit, the oxygen sensor output will not indicate the actual exhaust conditions and the control system logic will then tend to force an air-to-fuel ratio which will be substantially removed from stoichiometric. The result will be highly inefficient engine burning and an exhaust gas condition which will result in a three way conversion catalyst virtually failing to function in either the oxidation mode or the reduction mode and perhaps causing production of currently unregulated gaseous emissions such as ammonia, hydrogen cyanide and hydrogen sulfide. The gases therefore exhausted to the atmosphere can contain a high pollutant content.

Accordingly, it is a major purpose of this invention to provide a control system for use with the catalyst which will permit the catalyst to continue to operate effectively even though the oxygen sensor or associated circuitry has failed.

Furthermore, there are conditions of operation such as sudden acceleration and sudden load changes, as when starting up a steep hill, in which the air-to-fuel ratio will initially swing substantially away from stoichiometric. Under such conditions, the control circuit operates to rapidly bring the ratio back to stoichiometric. It is important that any system to compensate for oxygen sensor failure or component failure not respond to such temporary deviations from stoichiometric as if they represent a failure condition. Accordingly, it is a further purpose of this invention to provide the above type of failure detection and compensatory system that will distinguish between normal operation deviations from stoichiometric and false signals due to component malfunction.

BRIEF DESCRIPTION

In brief, in one embodiment, an oxygen sensor responds to the level of oxygen in the exhaust of an internal combustion engine and provides an electric signal having a value representative of the oxygen level in the exhaust. A fuel metering mechanism is responsive to a number of inputs including engine speed and accelerator position. One of the inputs that partially affects the amount of fuel provided is the output signal from an air-to-fuel ratio control circuit. The output of this control circuit is a function of the oxygen level signal from the oxygen sensor. When the signal indicates that the air-to-fuel ratio is too rich (has too much fuel), then the oxygen level signal causes the control circuit to bias the air-to-fuel ratio control mechanism to slightly decrease the amount of fuel injected. Similarly, when the signal indicates too great a level of oxygen (too lean a mixture) then the oxygen level signal causes a bias on the air-to-fuel ratio control mechanism to slightly increase the amount of fuel provided to the engine. The oxygen sensor output is thus used to bias the air-to-fuel ratio control mechanism toward a stoichiometric ratio.

The three-way conversion catalyst operates to promote oxidation of unburned hydrocarbons and carbon monoxide and also to promote reduction of nitrogen oxides so as to minimize the level of all three of these components in the exhaust. This three way catalyst operates best where the air-to-fuel ratio is stoichiometric or close to stoichiometric. But the changing mode of vehicle operation inevitably causes the engine to vary around stoichiometric even though it is preset to maintain stoichiometric. This variation occurs even when an oxygen sensor, air-to-fuel ratio control system is employed. It is important that the range of the variation be within predetermined limits and that it tend toward an average stoichiometric value. Accordingly, the air-to-fuel ratio control mechanism responds to the oxygen sensor output to bias the air-to-fuel ratio toward stoichiometric. But, if the oxygen sensor or associated circuitry malfunctions or fails to operate for reasons such as the development of a short or an open circuit, the signal sensed by the control circuit will be inaccurate and the control system will respond to grossly erroneous information. The control system will then tend to bias the air-to-fuel ratio to a value substantially removed from stoichiometric. Fuel combustion will be inefficient, there will be substantial production of undesirable pollutants and the catalyst will be relatively ineffective.

Accordingly, a first operational amplifier comparator compares the oxygen level signal against a first predetermined reference signal. This first reference signal has a value corresponding to an oxygen sensor signal obtained when the mixture being burned has a predetermined air-to-fuel ratio greater than stoichiometric. A second operational amplifier comparator compares the oxygen level signal against a second predetermined reference signal. This second reference signal has a value corresponding to an oxygen sensor signal obtained when the mixture being burned has a predetermined air-to-fuel ratio less than stoichiometric.

If the oxygen sensor or circuitry malfunctions so that it provides a severely erroneous oxygen level signal that is too high, the first comparator provides a first output signal and if the oxygen sensor malfunctions to provide a severely erroneous oxygen level signal that is too low, the second comparator provides a second output signal. Either of these comparator output signals actuates an indicator to inform the user of the fact that there is a malfunction.

A switching means is actuated by either comparator output signal to disable the output of the air-to-fuel ratio control circuit and to switch in a predetermined signal in lieu of the control circuit output. This predetermined signal sets or biases the air-to-fuel ratio control mechanism to a set point consistent with a stoichiometric air-to-fuel mixture or other preferred setting such as a lean setting where the hydrocarbon and carbon monoxide fractions can be removed by the catalyst but not the $NO_x$ fraction.

A time delay of, for example, 1.0 to 10.0 seconds is imposed on any comparator output signal at the input to the switching means so that the control circuit is not switched out until the aberrant sensor signal has persisted for the 1.0 to 10.0 seconds. Thus normal operating deviations from stoichiometric do not trigger the switching means or indicator.

BRIEF DESCRIPTION OF THE DRAWINGS

FIG. 2 indicates the electric circuitry in some detail that is between the output of the oxygen sensor and the input to the time delay switch.

DESCRIPTION OF THE PREFERRED EMBODIMENTS

Figure 1:
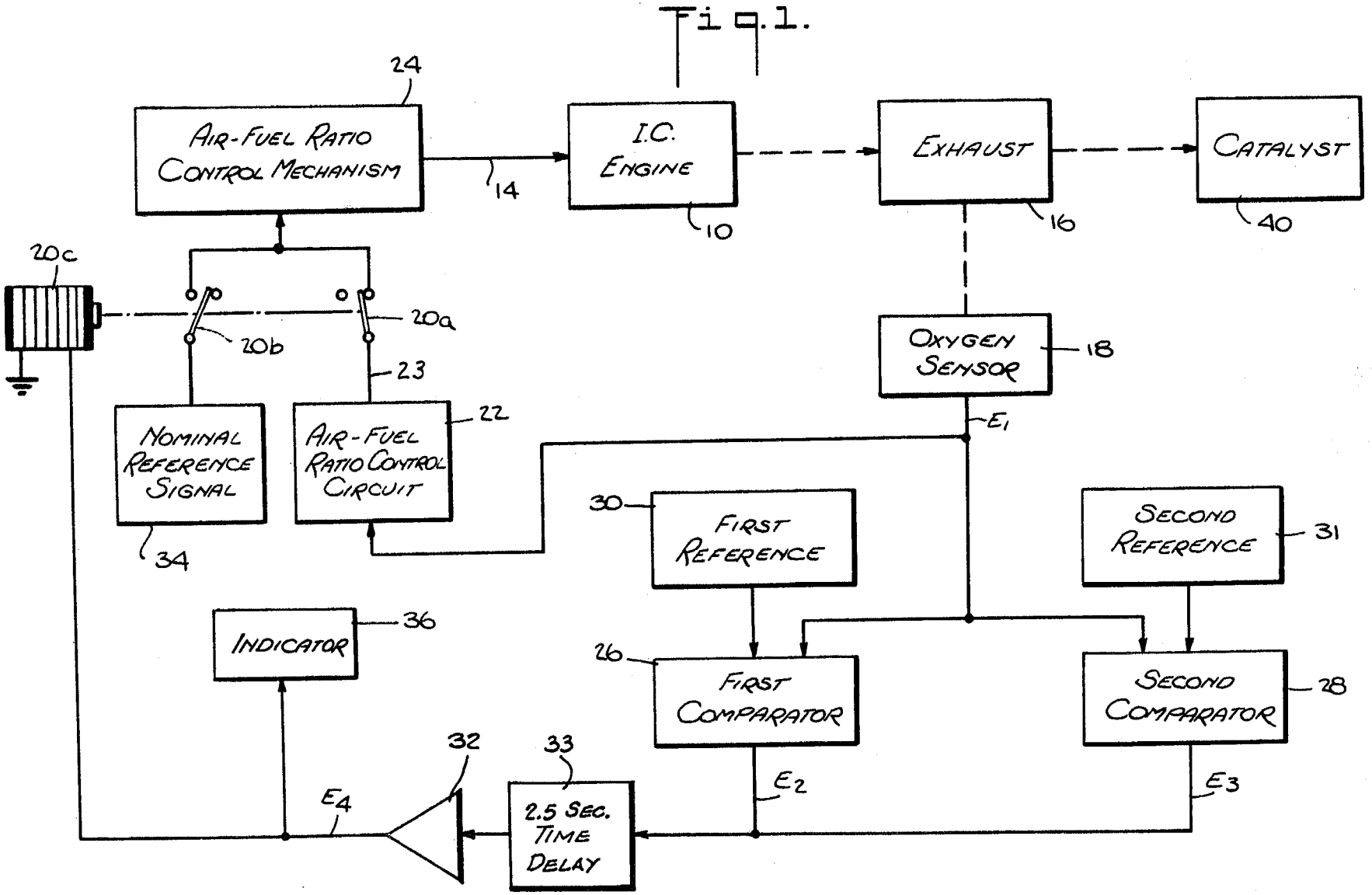
FIG. 1 is an electrical and a mechanical block diagram illustrating the exhaust pollution control system incorporating this invention.

The FIGS. both relate to the same embodiment. As shown broadly in FIG. 1, the system of this invention operates on an internal combustion engine 10 into which air and fuel is fed as represented by intake arrow 14. The engine 10, after combustion of air and fuel, provides an exhaust schematically represented at 16. A known type of oxygen sensor 18 is inserted into the exhaust and provides an electrical signal E1 (after buffer amplifier 44 shown in FIG. 2) having a value that is a function of the amount of oxygen in the exhaust 16. In the following description it will be assumed that E1 is inversely proportional to the oxygen content of the exhaust gases. The output electrical signal E1 from the oxygen sensor 18 is applied to an air-to-fuel ratio control electronic circuit 22. This circuit 22 is not described in detail herein because there are known circuits which will perform this function. There may be other inputs to the ratio control circuit 22 so that the oxygen sensor 18 output signal E1 represents only one of the parameters which may affect a control signal output 23 from the ratio control circuit 22. The control signal 23 is applied, through normally closed switch contact **20*a*, as the control input to the air-to-fuel ratio control mechanism 24**.

The control circuit 22 is arranged such that when the oxygen sensor 18 output signal E1 indicates an amount of oxygen less than occurs at stoichiometric burning, the control signal 23 is biased to create a leaner air-to-fuel ratio (that is to decrease the amount of fuel relative to the amount of air) as to bring burning back towards stoichiometric. Similarly, the control circuit 22 is arranged so that when the oxygen sensor output signal E1 indicates an amount of oxygen greater than would be available at a stoichiometric ratio, then the control signal 23 is shifted to bias the control mechanism 24 to increase the amount of fuel relative to the amount of air and thus bring the ratio closer to stoichiometric. In this fashion a closed loop servocontrol type of arrangement is provided which tends to bring the ratio towards stoichiometric. However, normal operation of any vehicle having an internal combustion engine is such that the ratio will vary around stoichiometric. Where a three way catalyst is employed to minimize exhaust pollution, variation around stoichiometric is believed to be preferable to operation continuously above or continuously below stoichiometric because the catalyst is designed for both above stoichiometric operation as well as below stoichiometric operation.

The oxygen sensor 18 output signal is also applied as one of the two inputs to a first comparator 26 and as one of the two inputs to a second comparator 28.

A first reference circuit 30 applies a first reference signal of, for example, 100 millivolts as the other input to the first comparator circuit 26. When the oxygen sensor 18 output drops drastically, as would occur if there were failure due to a short, to below 100 millivolts, the first comparator 26 will provide a first error signal output E2.

A second reference circuit 31 provides a second reference signal of, for example, 800 millivolts as the other input to the second comparator circuit 28. If the oxygen sensor output 18 rises above 800 millivolts, the second comparator 28 will provide a second error signal output E3. If an open circuit occurs, then the input to the second comparator 28 will rise to about 900 millivolts and the second error signal E3 will be generated.

The error signals E2 and E3 are applied through a 2.5 second time delay circuit 33 to a buffer amplifier 32. If the error signal E2 or E3 persists for more than 2.5 seconds, a switching signal output E4 will be applied to the switch coil **20*c* to switch the contacts 20*a*, 20*b* from the state shown in FIG. 1 to an inverse state. Thus when an error signal E2 or E3 persists for 2.5 seconds, the normally closed switch contact 20*a* is opened and any erroneous ratio control signal output 23 will be removed from the control mechanism 24**.

A source 34 provides a nominal reference signal which is applied to the normally open terminal **20*b* of the switch shown in FIG. 1. The magnitude of the nominal reference signal is predetermined and is selected to about equal the magnitude of the ratio control circuit 22 output when the system is responding to engine operation with a stoichiometric air-to-fuel ratio or other air-to-fuel ratio of choice, for instance a slightly oxidizing air-to-fuel ratio. When the switch coil 20*c*** is energized by the switch signal E4, the contact 20*b* closes and the nominal reference signal is applied to the ratio control mechanism in lieu of the control circuit 22 output 23.

The switch signal E4 also energizes an indicator lamp 36 so that the operator will have an indication that there is malfunction and that the oxygen sensor based control system is not working.

As indicated in FIG. 1, the three way catalyst 40 is located downstream from the exhaust location at which the oxygen sensor 18 is placed. Thus the sensor signal E1 is a measure of the level of oxygen after combustion and before the cleaning up effect of the catalyst 40. The system shown tends to optimize the use of the catalyst 40 in that the exhaust constituents will have a relationship of hydrocarbons, carbon monoxide and nitrogen oxides on which the catalyst 40 provides an optimum conversion to carbon dioxide, water and free nitrogen. More particularly, the catalyst 40, which performs both an oxidation function and a reduction function will operate optimally because the system shown will tend to force combustion to within a range close to stoichiometric.

If the oxygen sensor 18 fails either because an open circuit develops in the sensor apparatus or because the sensor apparatus develops a short, the output signal E1 will provide seriously erroneous information and will cause the control circuit 22 to bias or set the air-to-fuel ratio control mechanism 24 to a condition far removed from stoichiometric. The control bias will then cause a worse condition to prevail than if there were no control. Under such extreme conditions, the catalyst 40 will not be effective to clean up the exhaust and the pollutant output from the vehicle will appreciably increase. In addition, engine performance will deteriorate. However, in the system shown a seriously divergent sensor signal E1 which persists for more than 2.5 seconds will bring about a change in switch state so that the control circuit 22 output 23 will be removed from the control mechanism 24 and the nominal reference signal will be applied to the control mechanism 24. The control system then will not be responsive to changes in the operation of the engine 10. But it will at least provide a bias on the air-to-fuel ratio control mechanism 24 that is consistent with a stoichiometric ratio or alternatively, an oxidizing ratio. Thus, failure by the sensor 18 will not result in a more undesirable condition than would exist if there were no control system.

Because the operation of the vehicle inevitably involves load and speed change, the air-to-fuel ratio will inevitably shift away from stoichiometric until an adjustment back to stoichiometric can be made. The normal, temporary, deviations from stoichiometric tend to occur within a certain acceptable air-to-fuel ratio range. The output of the oxygen sensor 18 within the acceptable range will vary from vehicle to vehicle and will be a function of a number of characteristics and parameters. In one example, the sensor 18 output E1 may vary from about 100 millivolts to about 800 millivolts while the engine is operating within the acceptable range. This substantial range of sensor 18 output represents only a relatively small range above and below stoichiometric. The sensor 18 is very sensitive to oxygen level variations above and below stoichiometric.

However, there are conditions of operation under which the engine 10 will have to operate substantially removed from stoichiometric and thus substantially outside of the acceptable range. Under conditions of sudden normal to heavy acceleration and sudden sharp deceleration, the engine will often operate on an air-to-fuel ratio substantially removed from stoichiometric and outside the acceptable range. Under such conditions, the sensor output E1 could well be either below 100 millivolts or above 800 millivolts. It is desirable to avoid responding to these conditions as if they were oxygen sensor failure. More particularly, it is important that the control circuit shown function to correct the air-to-fuel ratio in response to these extreme oxygen sensor output signals that occur when the engine is subject to sharp acceleration changes.

Accordingly, the 2.5 second time delay circuit 33 prevents most such signals from being passed through to the indicator 36 and switch coil 20*c*. in this fashion, control by the oxygen sensor 18 is bypassed or disabled substantially only when there has been failure in the oxygen sensor 18 associated circuitry.

Although the control system disclosed would operate whether or not the catalyst 40 is part of the overall engine and vehicle system, the importance of maintaining the stoichiometric ratio within a narrow range and of bringing it into that range as soon as possible whenever there are deviations from that range is particularly great where the catalyst 40 performs both oxidation and reduction functions. Most particularly, it is important where the three-way conversion catalyst is employed.

Figure 2:
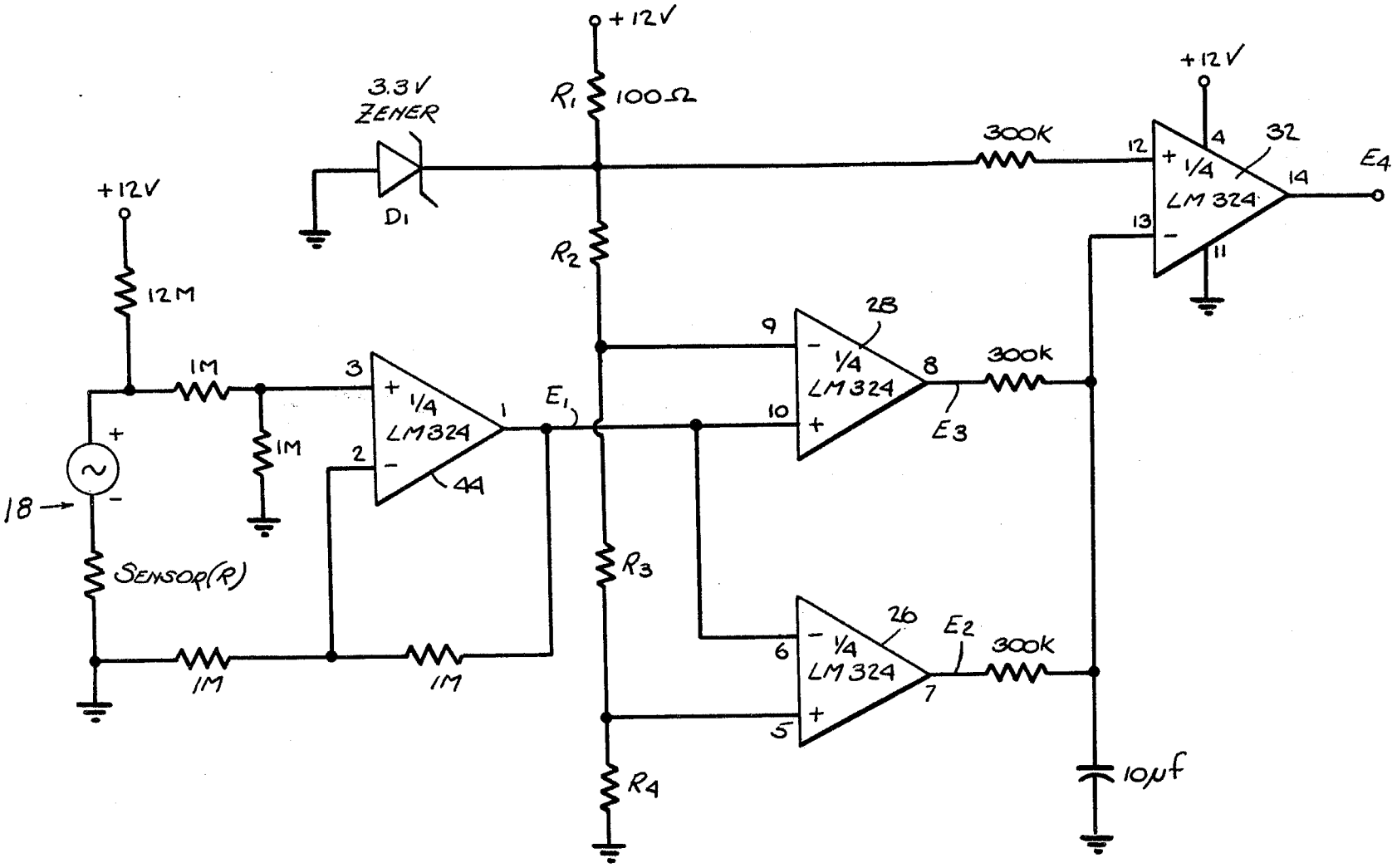
FIG. 2 is an electrical schematic and block diagram of a portion of the FIG. 1 system.

FIG. 2 illustrates some of the details of the protective circuitry shown in block form in FIG. 1. The sensor 18 output is applied to a buffer amplifier 44 to provide the signal E1 that is then applied to the comparators 26 and 28 as well as to the control circuit 22. This buffer amplifier 44 is to prevent signal loading and is nominally designed to provide an amplification factor of one. The reference voltages at pins 5 and 9 are developed off a resistor voltage divider network R1, R2, R3, R4. The Zener diode D1 provides a voltage of approximately 3.3 volts.

The reference voltage applied at pin 5 of comparator 26 is approximately 100 millivolts and the reference voltage applied at pin 9 of the second comparator 28 is approximately 800 millivolts.

The pins indicated are the pins of the particular LM 324 quad amp integrated circuit employed. The portion of the integrated circuit employed for the comparator 26 and for the comparator 28 are wired as an electronic switch while the portion that is employed for the buffer amplifiers 32 and 44 are wired as an amplifier.

Although the invention has been described in connection with one particular and presently preferred embodiment, it should be understood that certain variations in the system disclosed could be made without departing from the scope of the invention.

For example, the system shown in one in which the control circuit 22 operates on a ratio control mechanism 24 that affects the amount of fuel. Obviously, a system could be constructed in which the amount of air is controlled rather than the amount of fuel. It is the air-to-fuel ratio that is controlled.

The operating characteristics of the catalyst may be such that the net quantity of pollutants are minimized where the average air-to-fuel ratio is slightly off stoichiometric. Under such a circumstance, the system may be designed to provide an average air-to-fuel ratio slightly removed from stoichiometric.

The above description presumes a fuel injection system. But the invention can be readily adapted to a carburetor fuel metering system.

It should also be understood that there are override arrangements that would override the control circuitry shown under certain conditions. For example, there are cold start responsive mechanisms and open throttle mechanisms which can be employed and which would override the circuits shown.

The description has referred to a three way catalyst as the means to perform the oxidation and reduction functions. A two bed catalyst composed of an oxidation catalyst and a separate reduction catalyst would also require the system protections described above.

It should be also understood that automatic or manual reset devices can easily be incorporated into the control system so that after the control system for instance, senses an oxygen sensor failure and switches to a predetermined air-to-fuel ratio, that the system can be reset back to the normal control mode.

What is claimed is:

1. In an internal combustion engine the improvement comprising:

an exhaust reduction and oxidation catalyst, an air-to-fuel ratio control means to control the air-to-fuel ratio of the engine, said control means having a first state and a second state, an oxygen sensor responsive to the level of oxygen in the exhaust upstream of said catalyst to provide an oxygen level signal, said oxygen sensor having a steep operating curve through the exhaust condition point that represents operation at a stoichiometric air to fuel ratio, said control means, when in said first state, being responsive to said oxygen level signal, said signal biasing said control means in a direction tending to provide a predetermined average air-to-fuel ratio, first comparator means responsive to said oxygen level signal to provide a first error signal when said oxygen level signal is greater than a first predetermined level, second comparator means responsive to said oxygen level signal to provide a second error signal when said oxygen level signal is less than a second predetermined level, one of said first and second predetermined levels representing combustion at substantially above said predetermined ratio and the other of said predetermined levels representing combustion at substantially under said predetermined ratio, time delay means responsive to both of said error signals to provide a switching signal when either of said error signals persists for longer than a predetermined time period, means to provide a predetermined reference signal simulating an input to said control means consistent with operation of said control means at approximately said predetermined average air-to-fuel ratio, said control means, when in said second state, being responsive to said predetermined reference signal, and switching means responsive to said switching signal to switch said air-to-fuel ratio control means from said first state to said second state when said switching signal is provided, said oxygen level signal being uncoupled from said control means when said control means is in said second state and said predetermined reference signal being uncoupled from said control means when said control means is in said first state.

2. The system of claim 1 further comprising an indicator means responsive to said switching signal to provide a visual indication of the existence of said switching signal.

3. The system improvement of claim 1 wherein said predetermined air-to-fuel ratio is stoichiometric or oxidizing.

4. The system improvement of claim 2 wherein said predetermined air-to-fuel ratio is stoichiometric or oxidizing.

5. In an internal combustion engine, the improvement comprising:

an exhaust reduction and oxidation catalyst, a control circuit to provide a control signal, an air-to-fuel ratio control mechanism responsive to said control signal to control the air-to-fuel ratio, an oxygen sensor responsive to the level of oxygen in the exhaust upstream of said catalyst to provide an oxygen level signal, said oxygen sensor having a steep operating characteristic curve through the exhaust condition point that represents operation at a stoichiometric air to fuel ratio, said control circuit being partially responsive to said oxygen level signal, said oxygen level signal setting said control circuit to provide a control signal that biases said control mechanism in a direction tending to provide a predetermined average air-to-fuel ratio, first comparator means responsive to said oxygen level signal to provide a first error signal when said oxygen level signal is greater than a first predetermined level, second comparator means responsive to said oxygen level signal to provide a second error signal when said oxygen level signal is less than a second predetermined level, one of said first and and second predetermined levels representing combustion at substantially above said predetermined ratio and the other of said predetermined levels representing combustion at substantially under said predetermined ratio, time delay means responsive to both of said error signals to provide a switiching signal when either of said error signals persists for longer than a predetermined time period, means to provide a predetermined reference signal simulating the control signal provided by said control circuit when the oxygen level signal input to said control circuit is that provided at approximately said predetermined air-to-fuel ratio, and switching means responsive to said switching signal to switch the response of said air-to-fuel ratio control mechanism from said control signal to said predetermined reference signal when said switching signal is provided by said time delay means.

6. The system of claim 5 further comprising an indicator means responsive to said switching signal to provide a visual indication of the existence of said switching signal.

7. The system improvement of claim 5 wherein said predetermined air-to-fuel ratio is stoichiometric or oxidizing.

8. The system improvement of claim 6 wherein said predetermined air-to-fuel ratio is stoichiometric or oxidizing.

* * * * *

UNITED STATES PATENT AND TRADEMARK OFFICE

CERTIFICATE OF CORRECTION

PATENT NO. : 4,202,301

DATED : May 13, 1980

INVENTOR(S) : Jack Early, John J. Mooney, Carl D. Keith

It is certified that error appears in the above-identified patent and that said Letters Patent are hereby corrected as shown below:

In column 6, line 54 change "in" (first occurrence) to --is--.

In column 8, line 39, delete the first occurrence of "and".

In column 8, line 45, change "switiching" to -- switching--.

Signed and Sealed this

*Nineteenth* Day of *August 1980*

[SEAL]

*Attest:*

SIDNEY A. DIAMOND

*Attesting Officer*

*Commissioner of Patents and Trademarl*